US006901969B2

(12) United States Patent
Siiter

(10) Patent No.: US 6,901,969 B2
(45) Date of Patent: Jun. 7, 2005

(54) PLUGS FOR USE IN CONDUITS TO REINFORCE AIR CONDITIONING DUCTS, AND METHODS OF MANUFACTURE AND USE

(76) Inventor: Donald H. Siiter, 4757 Cardena Plaza, Yorba Linda, CA (US) 92686

( * ) Notice: Subject to any disclaimer, the term of this patent is extended or adjusted under 35 U.S.C. 154(b) by 97 days.

(21) Appl. No.: 10/338,063

(22) Filed: Jan. 7, 2003

(65) Prior Publication Data

US 2003/0127146 A1 Jul. 10, 2003

Related U.S. Application Data

(60) Provisional application No. 60/346,526, filed on Jan. 8, 2002.

(51) Int. Cl.[7] ..... F16L 9/00

(52) U.S. Cl. ..... 138/172; 138/89; 138/96 R; 138/174; 138/DIG. 4

(58) Field of Search ..... 138/89, 90, 96 R, 138/96 T, 172–174, 176, DIG. 4

(56) References Cited

U.S. PATENT DOCUMENTS 3,883,942 A * 5/1975 Fichter et al. ..... 29/446
3,964,339 A * 6/1976 Antonio et al. ..... 74/551.9
4,249,578 A * 2/1981 Freeman ..... 138/172
4,391,771 A * 7/1983 Anthony ..... 376/451
4,434,816 A * 3/1984 Di Giovanni et al. ..... 138/109
4,811,759 A * 3/1989 Billoue ..... 138/89
4,946,143 A * 8/1990 Bauer et al. ..... 267/64.11
5,079,992 A * 1/1992 Bauer et al. ..... 91/422
5,253,901 A * 10/1993 Hunter ..... 285/424
5,531,299 A * 7/1996 Bataille ..... 188/322.17
6,116,833 A * 9/2000 Ellis ..... 411/384
6,170,530 B1 * 1/2001 Steblina ..... 138/89
6,484,385 B2 11/2002 Ellis ..... 29/517
2002/0015465 A1 * 2/2002 Brosset ..... 376/409

* cited by examiner

*Primary Examiner*—Patrick Brinson
(74) *Attorney, Agent, or Firm*—Knobbe Martens Olson & Bear LLP

(57) ABSTRACT

A method and apparatus for reinforcing duct work is provided. In one embodiment, a reinforcement comprises a conduit having a first end and a second end. A pair of plugs is insertable into the first and second ends of the conduit. Each of the plugs has a groove extending along the circumference of the plug, and the plugs are crimped inside the conduit along the grooves. Each of the plugs may have a threaded end extending out of the plug and being retractable into said plug. Alternatively, each of the plugs may have an internally threaded opening extending at least partially through the plug. In this embodiment, the conduit can be secured to duct work by aligning the conduit with holes in the duct work, and inserting a bolt through the holes and into the internally threaded openings of the plugs.

20 Claims, 22 Drawing Sheets

FIG. 2D
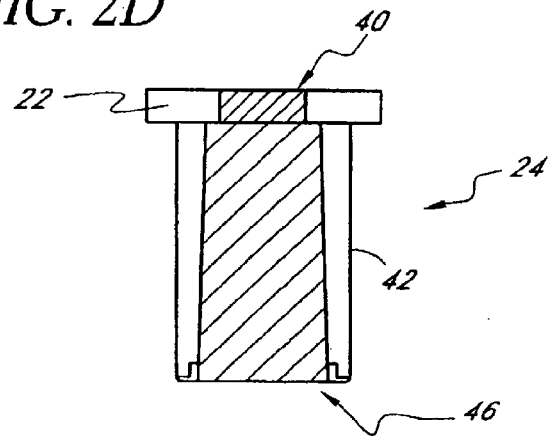
FIG. 2E
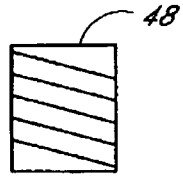
FIG. 2F
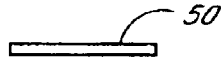
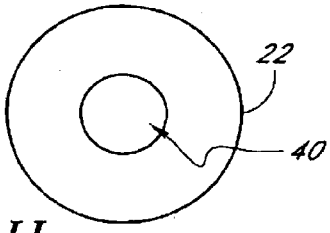
FIG. 2H
FIG. 2G
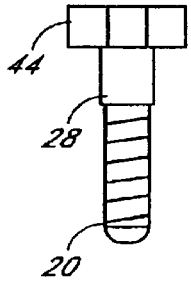
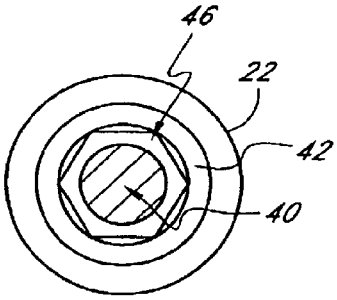
FIG. 2I
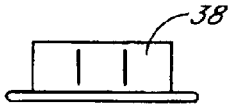
FIG. 2L
FIG. 2J
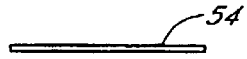
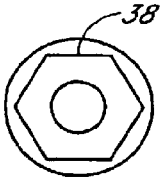
FIG. 2M
FIG. 2K
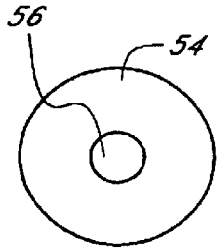

PLUGS FOR USE IN CONDUITS TO REINFORCE AIR CONDITIONING DUCTS, AND METHODS OF MANUFACTURE AND USE

CROSS-REFERENCE TO RELATED APPLICATION

This application claims the benefit of U.S. Provisional Application No. 60/346,526, filed Jan. 8, 2002, the entirety of which is hereby incorporated by reference.

BACKGROUND OF THE INVENTION

1. Field of the Invention

This invention relates to rods for reinforcing ductwork, and more particularly, to a reinforcing rod which is designed to enable a faster and easier installation into ductwork.

2. Description of the Related Art

Duct work, such as air conditioning ducts, are often made of a metallic material such as galvanized steel. These ducts require reinforcement to provide support to the ducts and to prevent them from bulging or buckling. One way that such reinforcement has been provided has been to surround the outside of the duct with an external reinforcement.

Another method that has been developed to reinforce air conditioning ducts and the like has been to position reinforcing rods or conduits on the interior of the ducts. In one previously known method, the length of the rod is threaded, and the rod is inserted into opposing holes in the walls of the duct and secured to these walls using a nut and washer configuration. One problem with this type of reinforcement is that the rods are necessarily longer than the distance between the walls of the duct, making it difficult to install the rods. This becomes especially problematic as the size of the duct decreases.

One previously known method to overcome this problem is to provide a conduit having a length corresponding to the distance between the opposing sides of the duct. Each end of the conduit is internally threaded, using an internally threaded nut press fit at each of the conduit. Then, by lining up the conduit with the opposing holes in the duct walls, bolts may be inserted from the outside of the duct through the internally threaded ends to secure the conduit within the ductwork. However, these conduits are difficult to align with the holes for insertion of the bolts. Moreover, these inserts can be pulled out of the conduits with a certain degree of force, thereby making the reinforcement ineffective.

Accordingly, what is needed is a method and apparatus for easily and quickly reinforcing an air conditioning duct and the like.

SUMMARY OF THE INVENTION

In one embodiment, a reinforcement is provided comprising a conduit having a first end and a second end. A pair of plugs is insertable into the first and second ends of the conduit. Each of the plugs has a groove extending along the circumference of the plug, and the plugs are crimped inside the conduit along the grooves. Each of the plugs may have a threaded end extending out of the plug and being retractable into said plug. Alternatively, each of the plugs may have an internally threaded opening extending at least partially through the plug. The reinforcement may then further comprise a bolt insertable into the threaded opening.

In another embodiment, a plug for insertion into an end of a conduit is provided. The plug comprises a body portion having a first end and a second end and an opening extending from the first end at least partially through said body portion. A groove extends at least partially along the circumference of the body portion, the groove adapted to receive a crimping force applied to the conduit when the plug is inserted into the end of the conduit. The plug may be internally threaded, or may further comprise a threaded member retractably positioned within the opening.

In another embodiment, a reinforced duct work is provided. The duct work has opposing surfaces, each of the surfaces having a hole therein aligned with an opposing hole. A conduit is provided having a first end and a second end, and has a plug inserted into each end thereof. Each plug has a groove extending along at least a portion of the plug, and the conduit is crimped to the plugs along the grooves. The conduit is positioned such that the first and second ends are aligned with the holes and the conduit is secured to the surfaces of the duct work. In one embodiment, the conduit may be secured to the surfaces of the duct work by bolts inserted through the holes in the duct work and into internally threaded holes in each plug at each end of the conduit. In another embodiment, each plug has a retractable threaded end which extends through one of the holes when the conduit is aligned therewith, and the conduit may be secured by nuts tightened over the retractable threaded ends against the surface corresponding to the holes.

In another embodiment, a method for reinforcing duct work is provided. The duct work has opposing surfaces, each of the surfaces having a hole therein aligned with an opposing hole. The method comprises providing a conduit having a first end and a second end, wherein the conduit has a plug inserted into each end thereof, each plug having a groove extending along at least a portion of the plug, and wherein the conduit is crimped to the plugs along the grooves. The conduit is positioned such that the first and second ends are aligned with the holes, and the conduit is secured to the duct work. In one embodiment, bolts may be inserted through the holes in the duct work and into internally threaded holes in each plug at each end of the conduit. The bolts are tightened within the plugs to secure the conduit to the duct work. In another embodiment, the plugs each have a retractable threaded end which extend through one of the holes when the conduit is aligned therewith. Nuts are tightened over the retractable threaded ends against the surface corresponding to the hole to secure the conduit to the duct work.

BRIEF DESCRIPTION OF THE DRAWINGS

FIG. 2D is a cut away side view of the body portion of the plug of FIG. 2C.

FIG. 2E is a side view of a spring insertable into the plug of FIG. 2C.

FIG. 2F is a side view of a tube cap for the plug of FIG. 2C.

FIG. 2G is a side view of an inside bolt for the plug of FIG. 2C.

FIG. 2H is a top view of the body portion of FIG. 2D.

FIG. 2I is a bottom view of the body portion of the FIG. 2D.

FIGS. 2J and 2K are side and top views, respectively, of a rubber washer.

FIGS. 2L and 2M are side and top views, respectively, of an outside nut.

DETAILED DESCRIPTION OF THE PREFERRED EMBODIMENTS

Preferred embodiments of this invention relate to reinforcement of duct work (e.g., for air conditioning ducts), and more particularly, to conduits used for reinforcing duct work. In particular, certain embodiments describe plugs for insertion into the ends of the conduits in order to provide for easier insertion into the duct work and/or a more secure connection and reinforcement.

Figure 1:
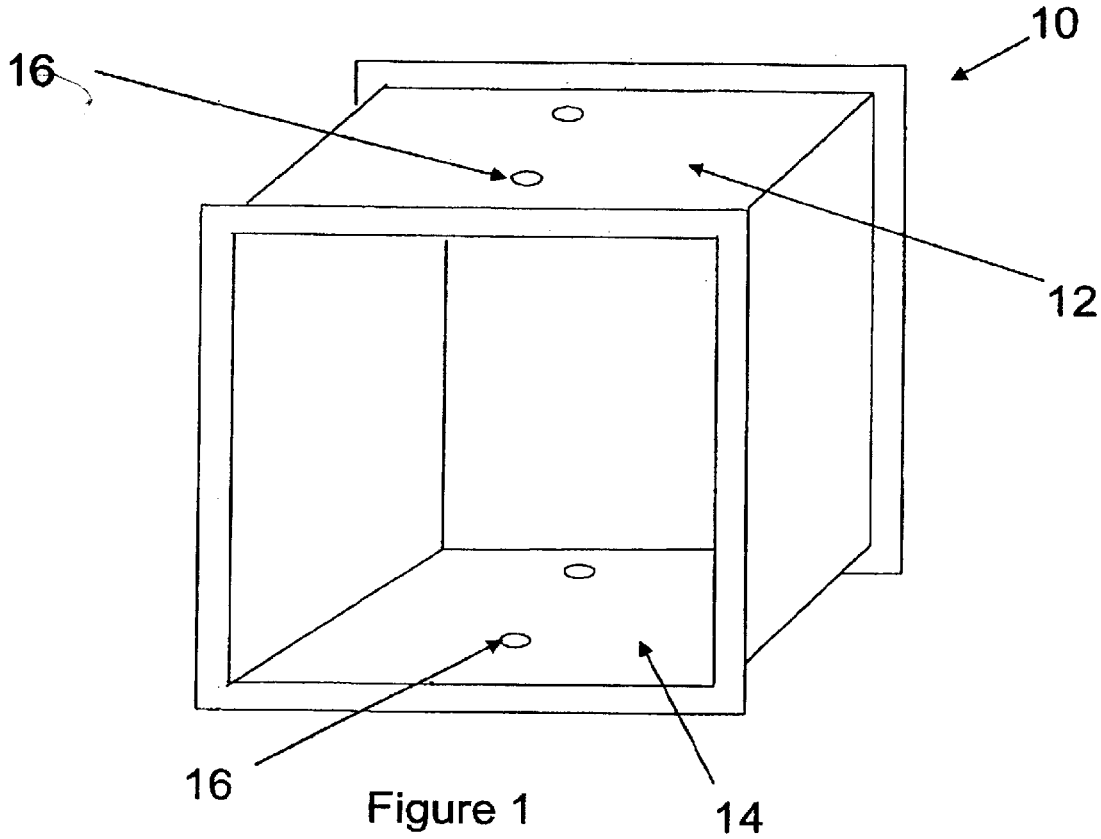
FIG. 1 is a perspective view of a portion of air conditioning duct.

FIG. 1 illustrates a portion of air conditioning duct 10. The duct has opposing surfaces 12 and 14, which include oppositely disposed holes 16. As described below, these holes 16 are used to reinforce the duct 10 to prevent it from buckling or collapse.

Figure 2A:
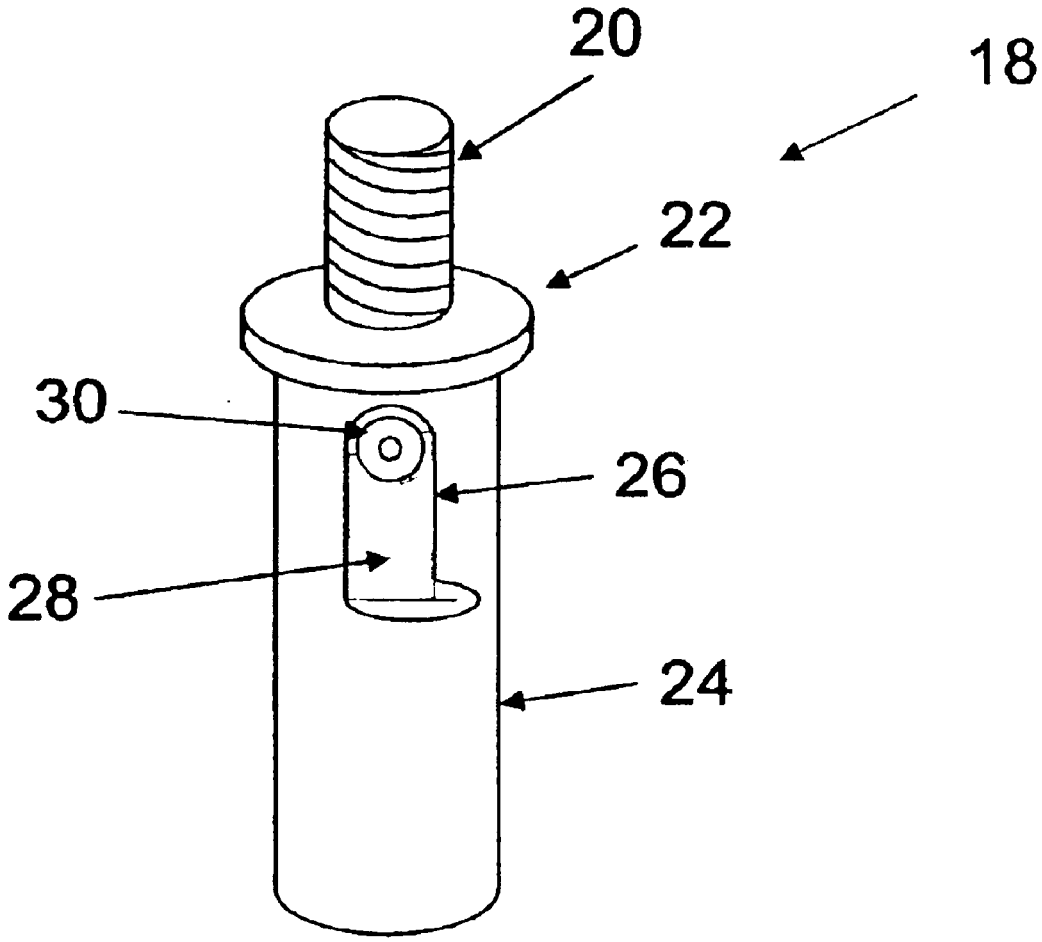
FIG. 2A is a perspective view of a plug with retractable threads according to one embodiment of the present invention, the threads being shown in their unretracted configuration.
Figure 2B:
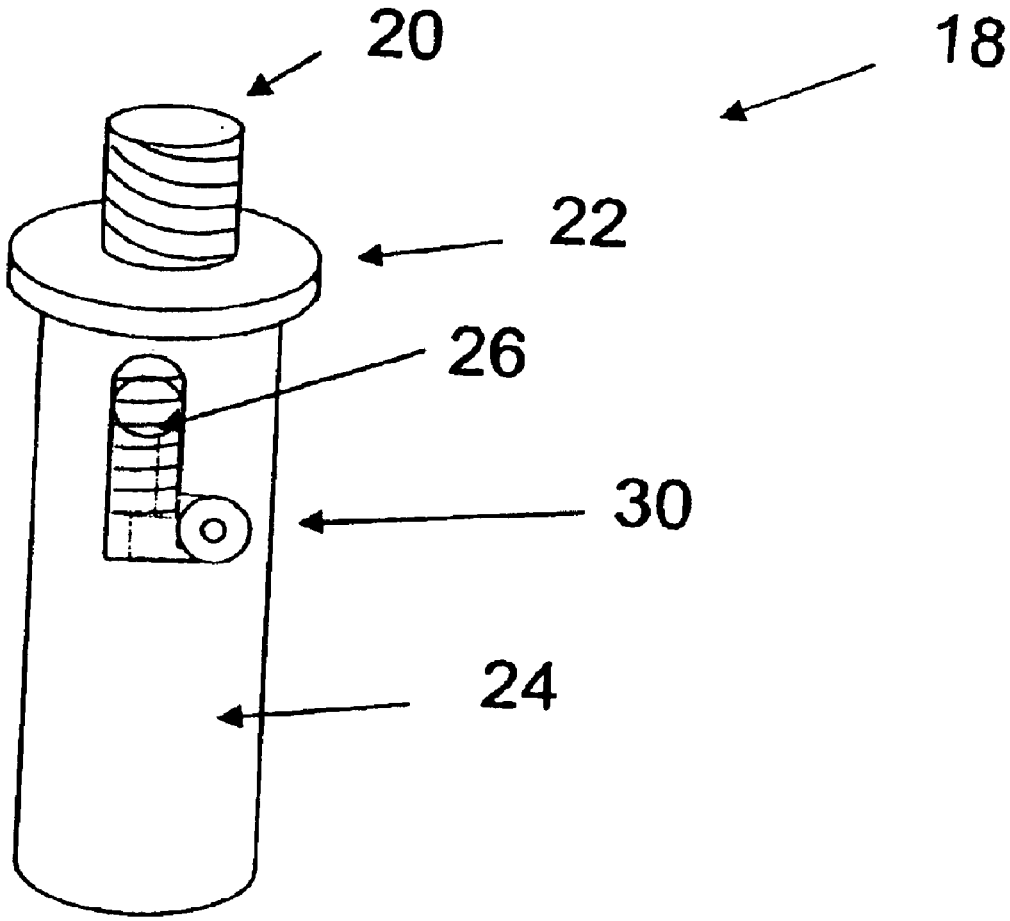
FIG. 2B is a perspective view of a plug with retractable threads according to one embodiment of the present invention, the threads being shown in their retracted configuration.

FIGS. 2A and 2B illustrate a plug with retractable threads according to one embodiment of the present invention. The plug 18, shown in its unretracted configuration in FIG. 2A, includes a threaded end 20, which moves into and out of the tubular body portion 24 through head 22. The threaded end 20 is integrally formed with a shaft 28 which remains internal to the tubular body portion 24. A spring (not shown) is also positioned within the tubular body portion 24 below the shaft 28.

Provided on the shaft 28 is a pin 30, which extends into an L-shaped cutout 26 provided in the wall of the body portion. The spring within the body portion presses against the bottom of the shaft 28, forcing the threaded end 20 outward relative to the head 22, and correspondingly, positioning the pin at the top of the "L." Thus, the pin 30, when contacting the top of the L-shaped cut-out, prevents the threaded end 20 and the shaft 28 from exiting the body portion 24, and also prevents rotation of the threaded end 20.

FIG. 2B illustrates that because of the spring within the body portion, the threaded end 20 can be pushed down, compressing the spring and thereafter moving the pin 30 into the bottom-right portion of the L-shaped cut-out. Thus, in this position, the threaded end 20 is in a "locked" or retracted configuration. Preferably, the threaded end 20 will still extend slightly beyond the head 22 in this locked configuration.

Figure 2C:
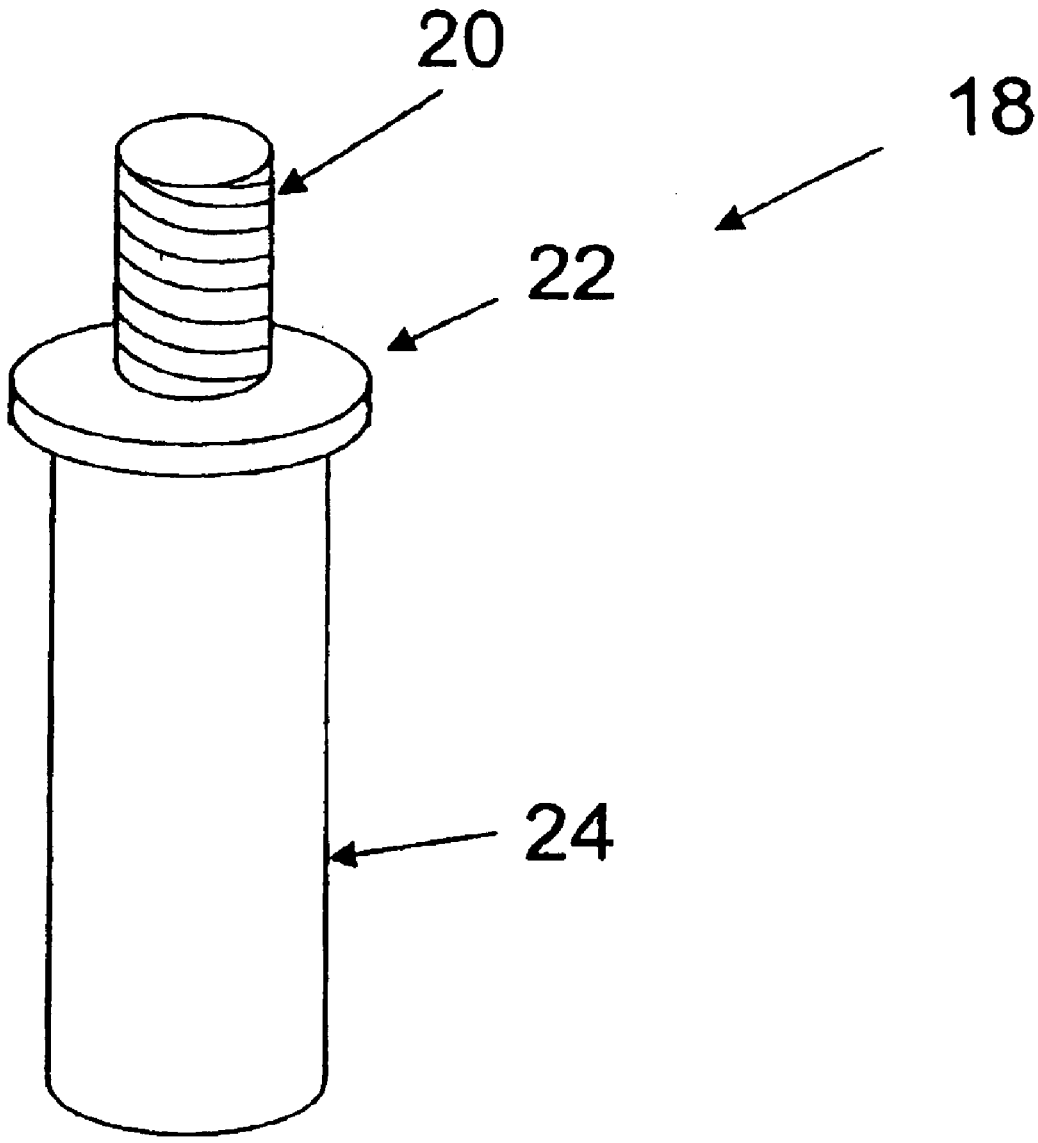
FIG. 2C is a perspective view of another embodiment of a plug with retractable threads.

It will be appreciated that although the plug 18 has been described as containing a locking mechanism 26, the plug may also be provided without such a locking mechanism. In such an embodiment, the plug 18 is in a relaxed position when the threaded end 20 is fully extending out of the body portion 24, as shown in FIG. 2C. Because of the spring inside the body portion 24, when a force is placed against the threaded end 20, causing the threaded end to move into the body portion, the threaded end will be biased to move back to its relaxed position unless the force on the threaded end is maintained.

FIGS. 2D–2G illustrate the components of the plug 18 of FIG. 2C, according to one preferred embodiment The body portion 24, shown in FIG. 2D, has a head portion 22 at its proximal end defining an opening 40 through which threaded end 20, described below, extends. The walls 42 of the body portion 24 are preferably tapered, such that the cavity 46 inside the body portion has a smaller diameter toward the proximal end of the body portion. FIG. 2H shows a top view of the body portion 24. As shown in the bottom view of the body portion 24 of FIG. 2I, the cavity 46 is preferably hex-shaped to accommodate a bolt having a hex-shaped base, as described below.

Provided inside the cavity of the body portion 24 are a spring 48 (shown in FIG. 2E) and an inside bolt 52 (shown in FIG. 2G). The inside bolt 52 includes a threaded end 20 extending from its proximal end, a hex-shaped base 44 at its distal end, and a shaft 28 therebetween. The inside bolt 52 is inserted into the cavity of the body portion 24 through its distal end, with the threaded end 20 entering first. The threaded end 20 is sized to pass through the opening 40, but the hex-shaped base 44 is sized larger than the opening 40 to prevent the inside bolt from falling out of the body portion 24 at its proximal end. Moreover, the hex-shaped base 44 approximately mates with the hex-shaped cavity 46 to prevent rotation of the bolt within the cavity. The spring 48 is inserted through the distal end of the body portion 24 after the inside bolt 52. A tube cap 50, as shown in FIG. 2F, seals the body portion 24 after the spring and inside bolt 52 have been inserted. The body portion 24 and the tube cap 50 are preferably made of a material such as aluminum or plastic. The other components of the plug are preferably made of a material such as steel and plated to prevent rust.

Figure 3:
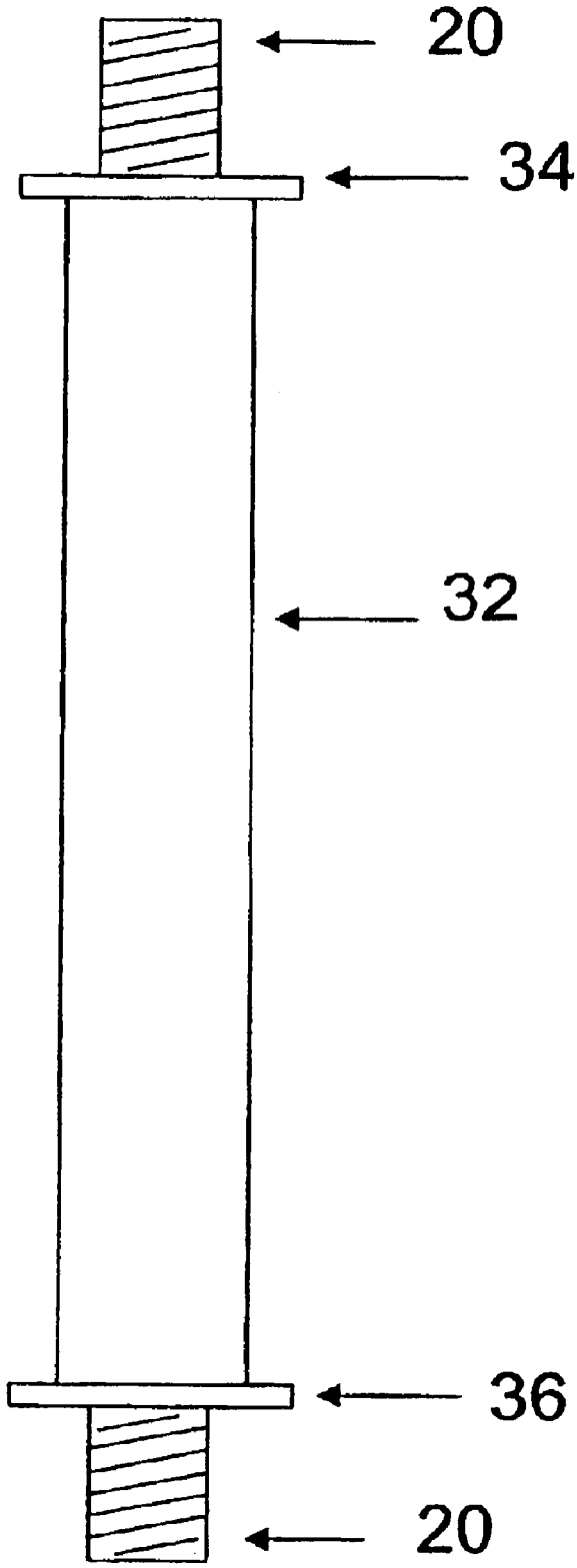
FIG. 3 is a side view of a conduit having a plug of with retractable threads inserted into its ends.

FIG. 3 illustrates that to reinforce an air conditioning duct such as shown in FIG. 1, the plugs 18 are placed in the two ends 34, 36 of a reinforcing conduit 32. Preferably, the plugs are press fit into the two ends. The distance between the two ends 34, 36 is preferably substantially the same as the distance between the opposing surfaces 12, 14 of the air conditioning duct.

To install the reinforcing conduit into the duct 10, the conduit 32 is inserted between the opposing surfaces 12, 14 of the duct 10. The threaded ends 20 of the plugs in the conduit, when pressed against the walls of the duct, are forced into the body portions 24, thereby shortening the length of the conduit with the plugs. This enables the conduit to be moved around more easily within the duct. The conduit 32 is preferably moved within the duct 10 until the threaded ends 20 encounter the opposing holes 16 of the duct. When the threaded ends 20 are free to unretract from the body portions 24 (i.e., the embodiment of FIG. 2C, wherein the threaded ends are not locked inside the body portion with a locking mechanism), the threaded ends will pop out once encountering the holes and extend to the outside of the duct 10.

Alternatively, if the threaded ends are locked such as shown in FIG. 2B above, because the threaded ends 20 extend slightly beyond the head 22, the installer can still ascertain when the threaded end encounters a hole 16. Then, the threaded ends 20 can be activated to their unretracted position simply by moving the pin 30 from the locked to the unlocked position.

It will be appreciated that when installing conduit as described above, it is often advantageous to install one end of the conduit 32 first into a hole 16, with the threaded end 20 at that one end already unretracted, and then simply orienting the conduit such that the other threaded end 20 encounters the opposing hole 16. In this embodiment, as the other threaded end 20 is brought towards the opposing hole 16, the end 20 will likely retract into the conduit as the force of the wall nearby the opposing hole 16 presses the threaded end 20 into the body portion 24.

In another embodiment, it will be appreciated that a conduit may be provided in which only one end has a retractable threaded end, while the other end has an threaded end which always extends out of the end of the conduit.

Figure 4:
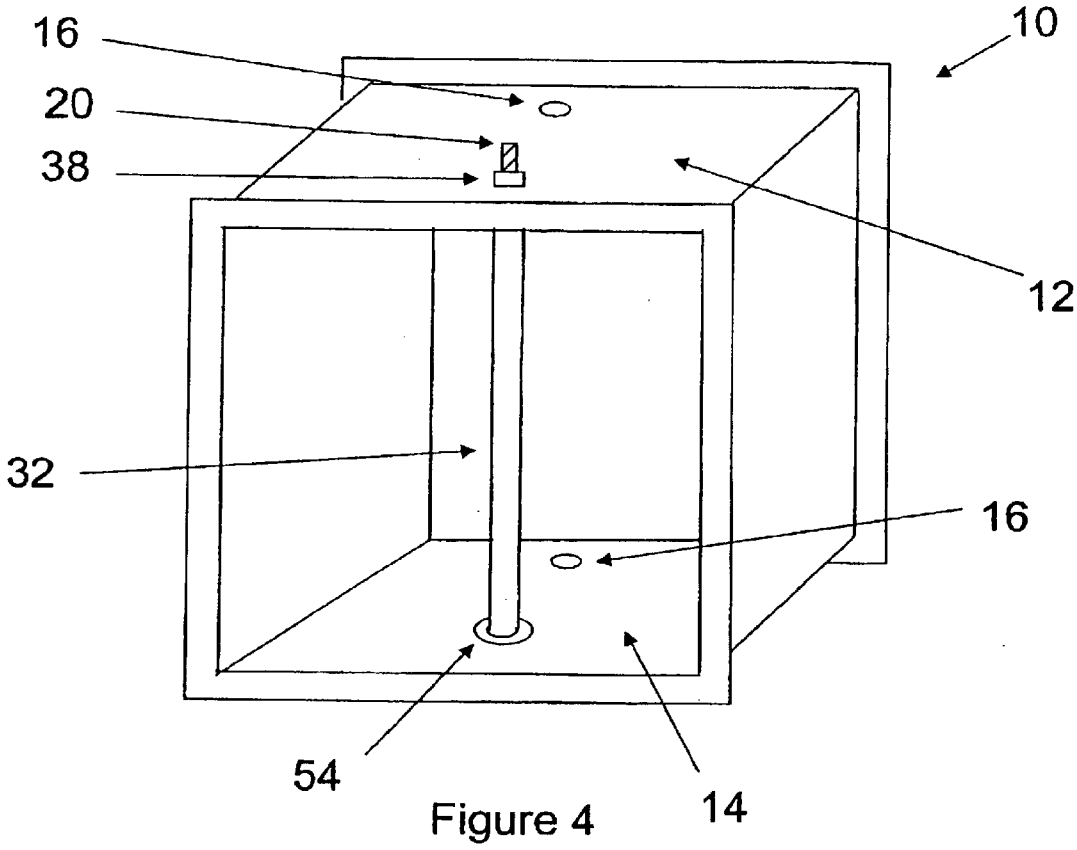
FIG. 4 is a perspective view of the air conditioning duct of FIG. 1 reinforced by the conduit of FIG. 3.

FIG. 4 illustrates a partially completed reinforced duct portion 10 with a reinforcing conduit 32 therein. As can be seen, the threaded ends 20 extend to the external surface of the duct, wherein an outside nut 38 is screwed onto the threaded end 20 and against the surface of the duct walls to secure the conduit in place. This nut 38 is shown more particularly in FIGS. 2L and 2M. When a body portion such as shown in FIG. 2D is used, as the outside nut 38 is screwed onto the inside bolt 52 of the body portion, the nut draws the bolt towards the nut. Because the walls 42 of the body portion 24 are tapered, the hex-shaped base 44 of the inside bolt 52 presses against the walls as the bolt 52 is drawn toward the nut 38. This exerts an additional pressure of the body portion 24 against the inner walls of the conduit 32, thereby holding the plug 18 more strongly within the conduit.

FIG. 4 also illustrates the use of a rubber washer 54, illustrated more particularly in FIGS. 2J and 2K. Prior to installation, rubber washers 54 can be placed against the heads 22 of the plugs 18 at each end of the conduit 32, with the threaded ends 20 extending through the holes 56 in the washers. Then, once the plugs 18 are aligned in the duct 10 and the threaded ends 20 extend through the holes 16, the rubber washers 54 abut against the surfaces 12, 14 of the duct to protect the duct from damage.

The embodiments described also improve over the prior art in which threaded reinforcement rods are used in that reinforcing conduits as described herein are stronger than threaded rods and therefore are more resistant to buckling.

Figure 5A:
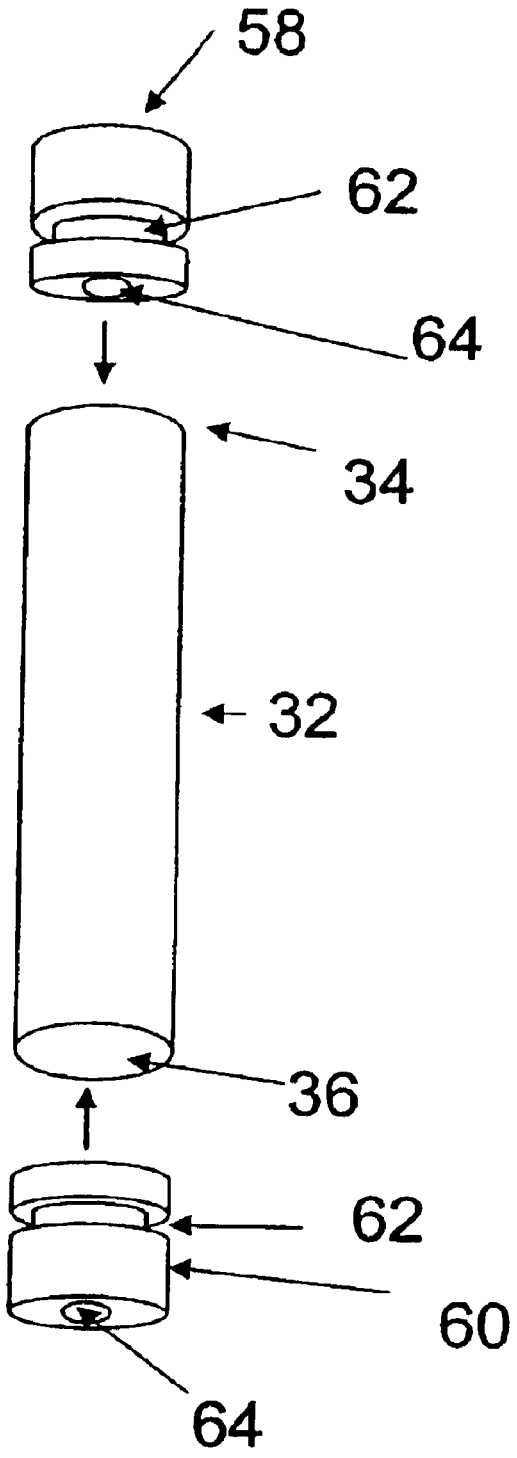
FIGS. 5A–5C are perspective views illustrating the insertion and crimping of grooved plugs into a conduit.
Figure 5B:
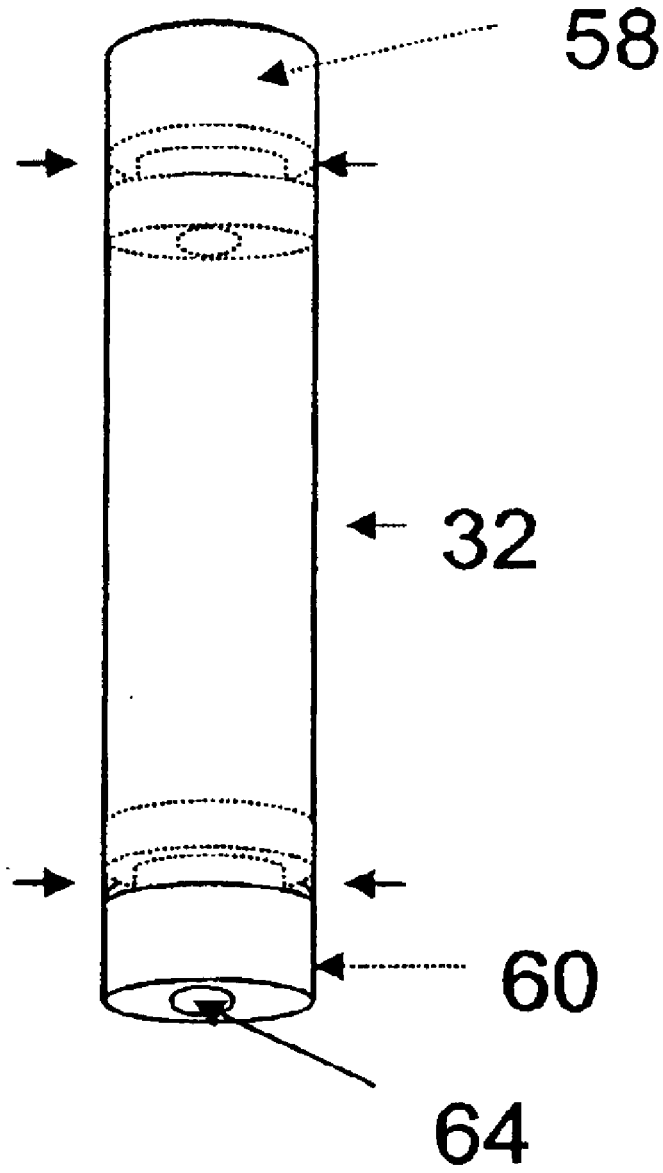
Figure 5C:
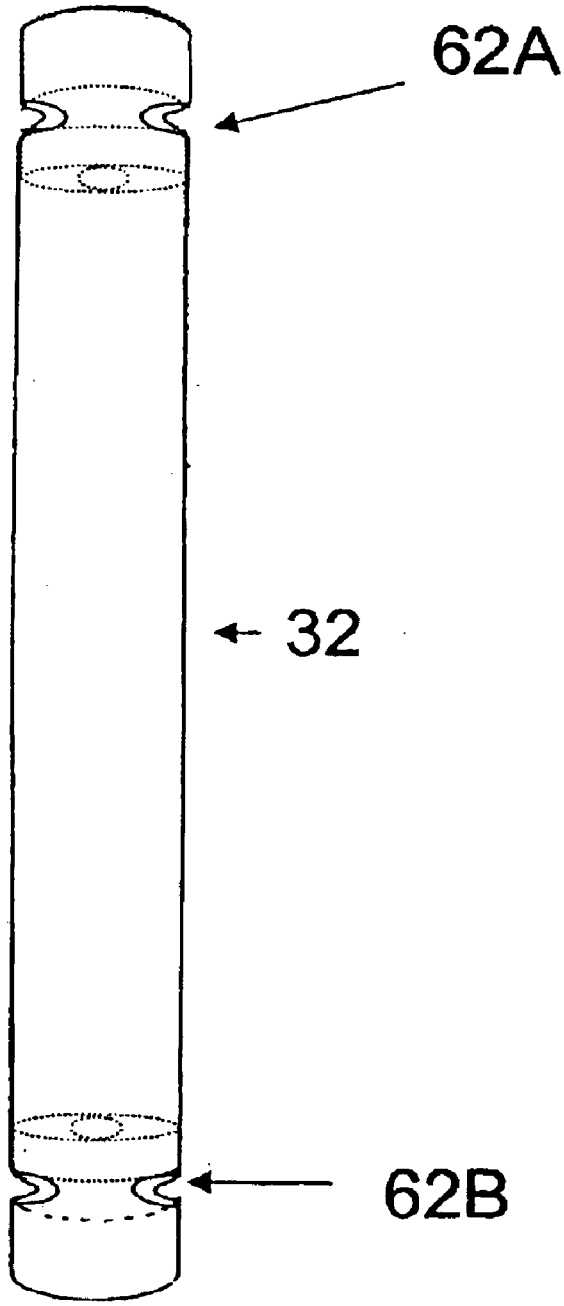
Figure 5D:
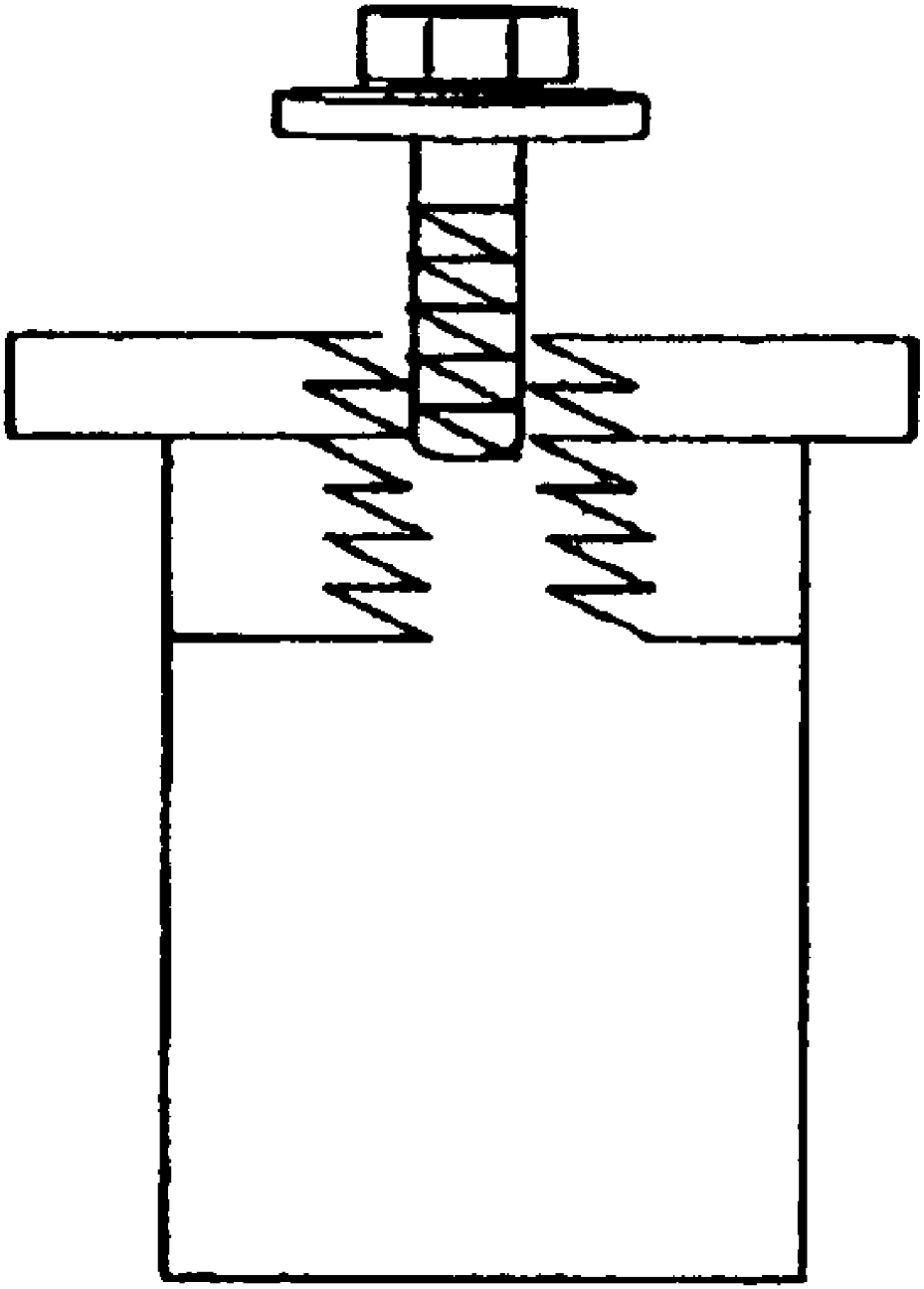
FIG. 5D is a partial cross-sectional view of an end of a conduit having a plug crimped therein.
Figure 5E:
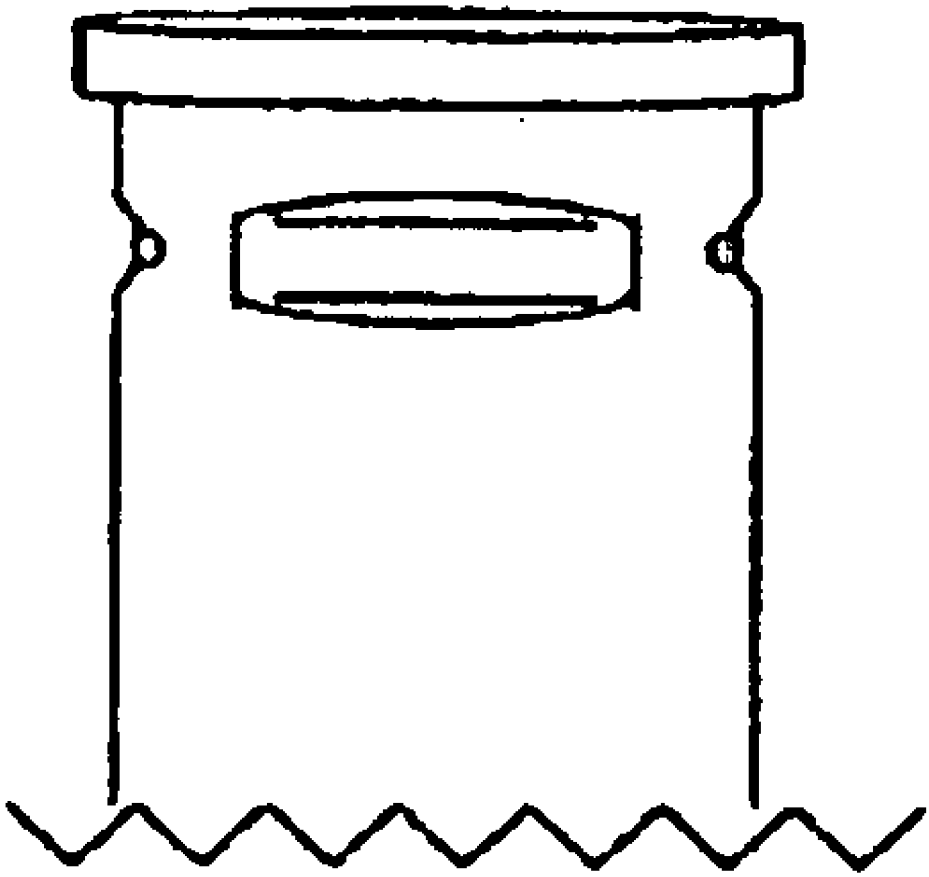
FIG. 5E is a side view of an end of a conduit having a plug crimped therein.

FIGS. 5A–5C illustrate another embodiment of a system for reinforcing air conditioning ducts and the like. In this embodiment, a conduit 32 such as described above is provided. Plugs 58 and 60 having an outer diameter corresponding to the inner diameter of the conduit are inserted into ends 34 and 36 of the conduit, respectively, until the outer ends of the plugs are flush with the ends of the conduit, as shown in FIG. 5B. As described in further detail below, the plugs 58 and 60 each have a groove 62 extending around the circumference of the plug and have an internally threaded opening 64 extending through the central axis of the plug. After the plugs are inserted into the conduit, a crimping device, such as described below, can be used to crimp the conduit at the location of the grooves 62, shown by the arrows in FIG. 5B. As shown in the resulting conduit in FIG. 5C, the crimping of the conduit locks the plugs 58 and 60 within the conduit at crimped locations 62A and 62B to prevent the plugs from being pulled out. FIG. 5D illustrates in cross-section one preferred plug crimped inside an end of a conduit, with a bolt screwed into the threaded opening 64 through a washer. FIG. 5E illustrates an end view of the crimped conduit.

Figure 6B:
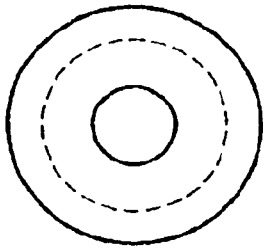
FIG. 6B is an end view of the plug of FIG. 6A.
Figure 6A:
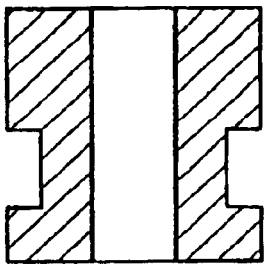
FIG. 6A is a cross-sectional view of one embodiment of a grooved plug.

FIGS. 6A and 6B illustrate one preferred design for the plugs 58 and 60. In this embodiment, the threaded opening 64 preferably has a diameter of about ¼" and extends entirely through the plug. The plug in one embodiment has a diameter of about 0.605" and a length of about 0.69", with the groove located about 0.33" from the outer end of the plug (i.e., the end that is flush with the end of the conduit) and about 0.15" from the inner end of the plug. The groove 62 in this embodiment preferably has a length of about 0.21 inches. As shown in FIG. 6B, the groove preferably has a depth of about 0.07 inches.

Figure 7B:
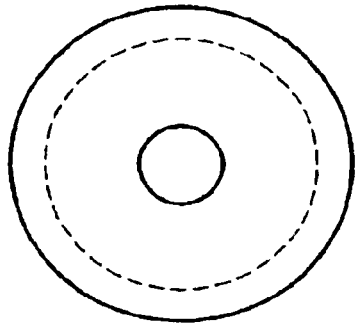
FIG. 7B is an end view of the plug of FIG. 6A.
Figure 7A:
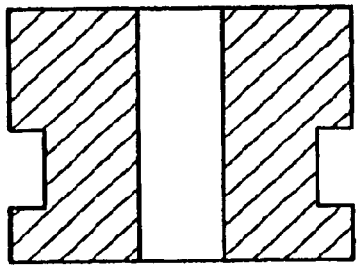
FIG. 7A is a cross-sectional view of another embodiment of a grooved plug.

FIGS. 7A and 7B illustrate another preferred design for the plugs 58 and 60. In this embodiment, the threaded opening 64 also has a diameter of about ¼", and the length and location of the groove are the same. However, the plug of FIGS. 7A and 7B has a diameter of about 0.81". It will be appreciated that plugs of various sizes may be used to accommodate different sized conduits.

Figure 8A:
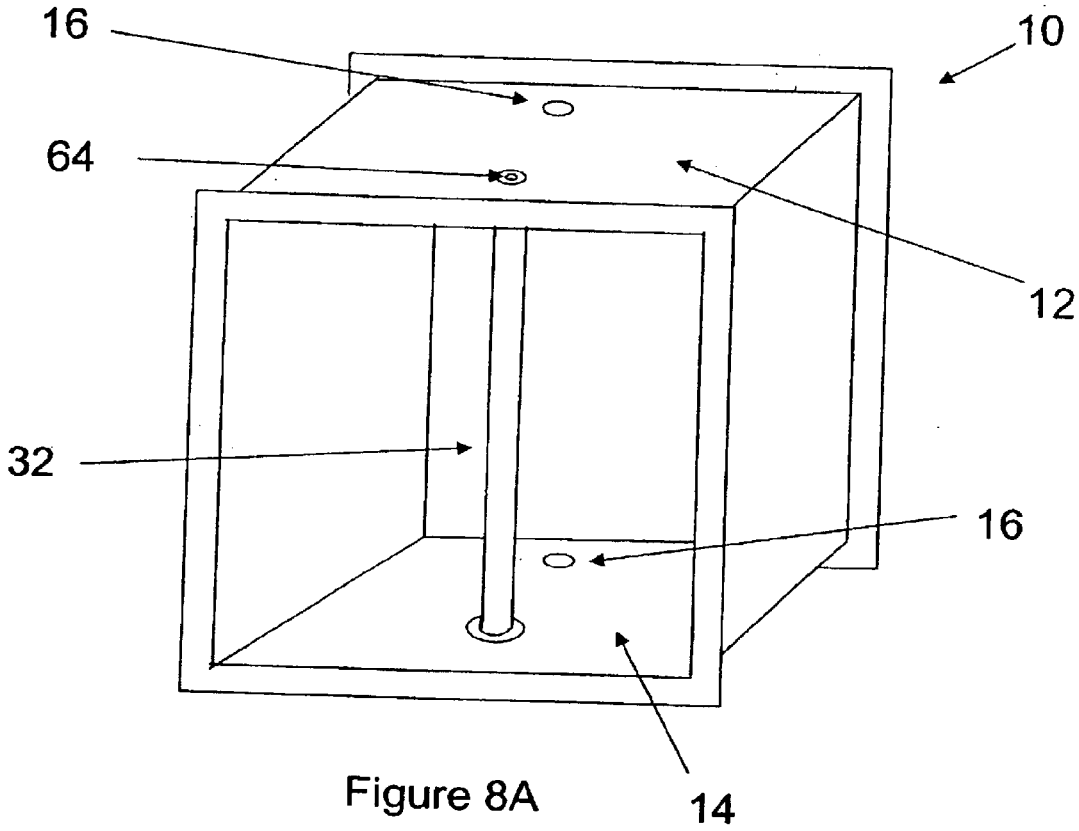
FIG. 8A is a perspective view of the air conditioning duct of FIG. 1, with the conduit of FIG. 5C inserted therein.
Figure 8B:
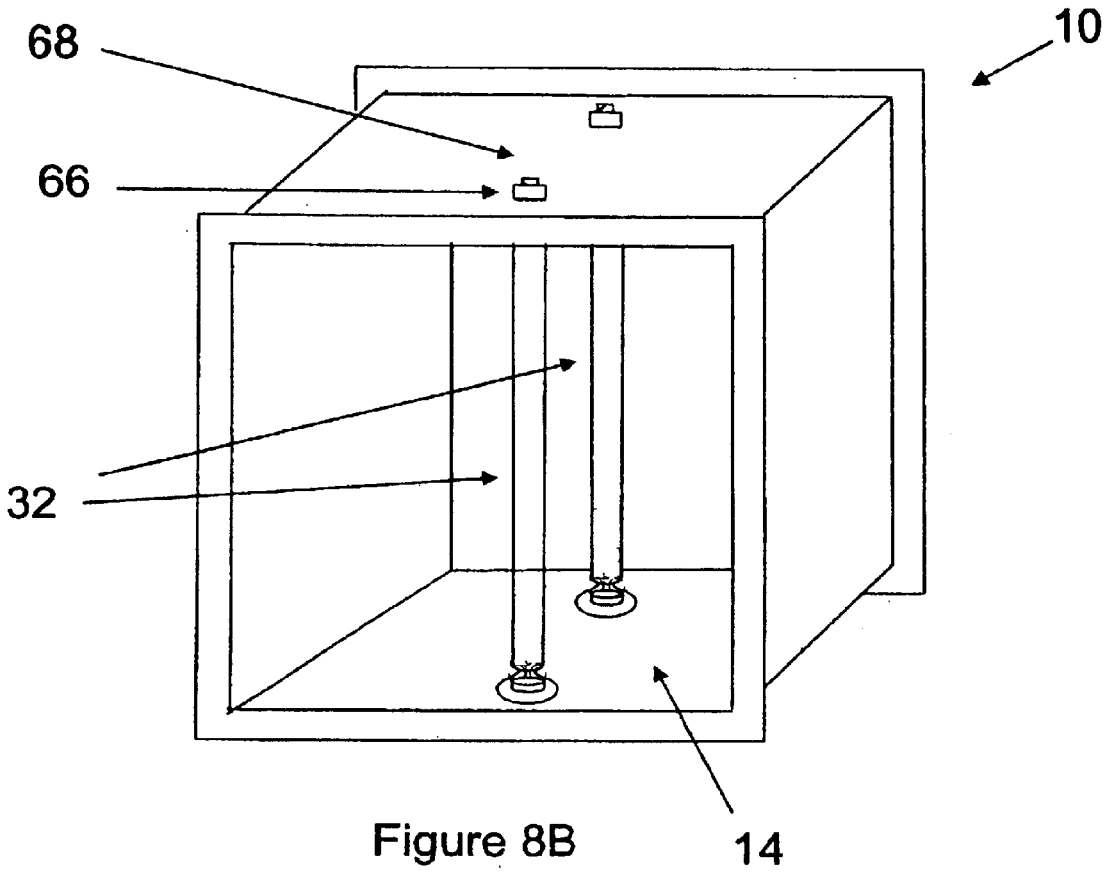
FIG. 8B is a perspective view of the air conditioning duct of FIG. 1 reinforced with the conduit of FIG. 5C.

FIG. 8A illustrate that after the plugs are inserted and crimped into the conduit as shown in FIG. 5C, the conduit can be aligned with holes 16 in the duct 10. As shown in FIG. 8B, from the outside of the duct, a washer 66 is positioned over the hole 16 and a bolt 68 is inserted through the washer, through the hole 16, and threadedly inserted into the opening 64 to secure the conduit within the duct. This process is repeated for each end of the conduit and for each conduit positioned in the duct.

It will be appreciated that the plugs 58 and 60 can be made from a variety of suitable materials. For example, certain preferred materials include, but are not limited to, nylon, steel and aluminum. Desired materials may be selected based on the superior pull out strength offered by the crimped plugs. For example, a nylon plug which has been injection molded desirably provides a pull out strength of about 800 to 1200 lbs. A steel plug desirably provides a pull out strength of about 3200 to 5000 lbs. An aluminum plug desirably provides a pull out strength of about 1500 to 2500 lbs. It will also be appreciated that to provide increased pull out strength, more than one groove 62 may be provided on the plugs.

Figure 9A:
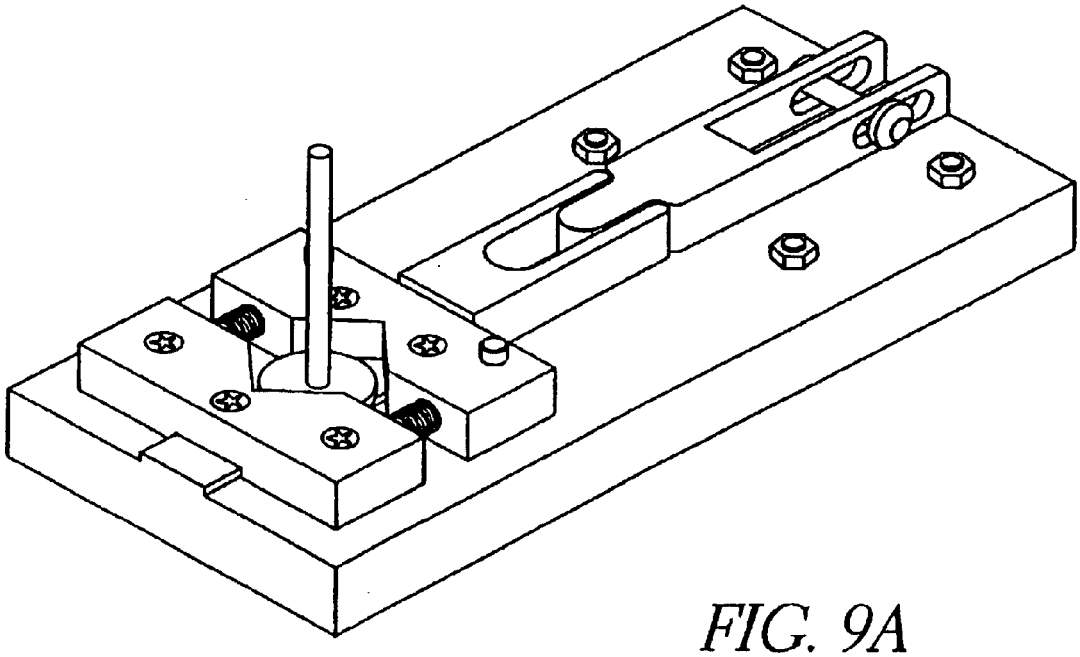
FIGS. 9A–9D illustrate one preferred sequence for crimping a conduit to a plug.
Figure 9B:
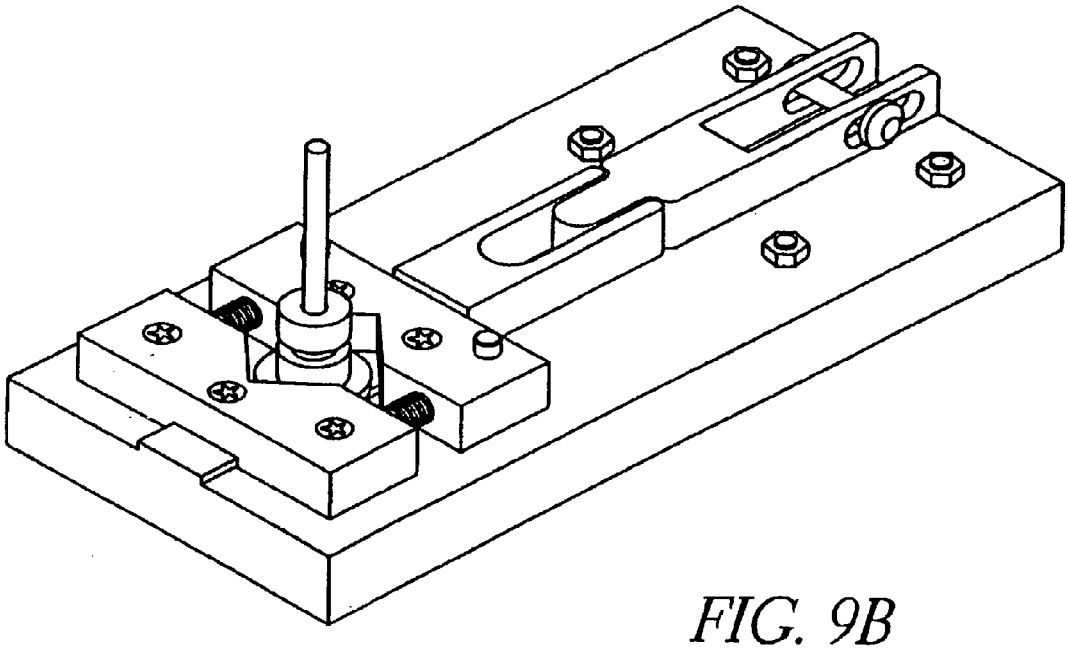
Figure 9C:
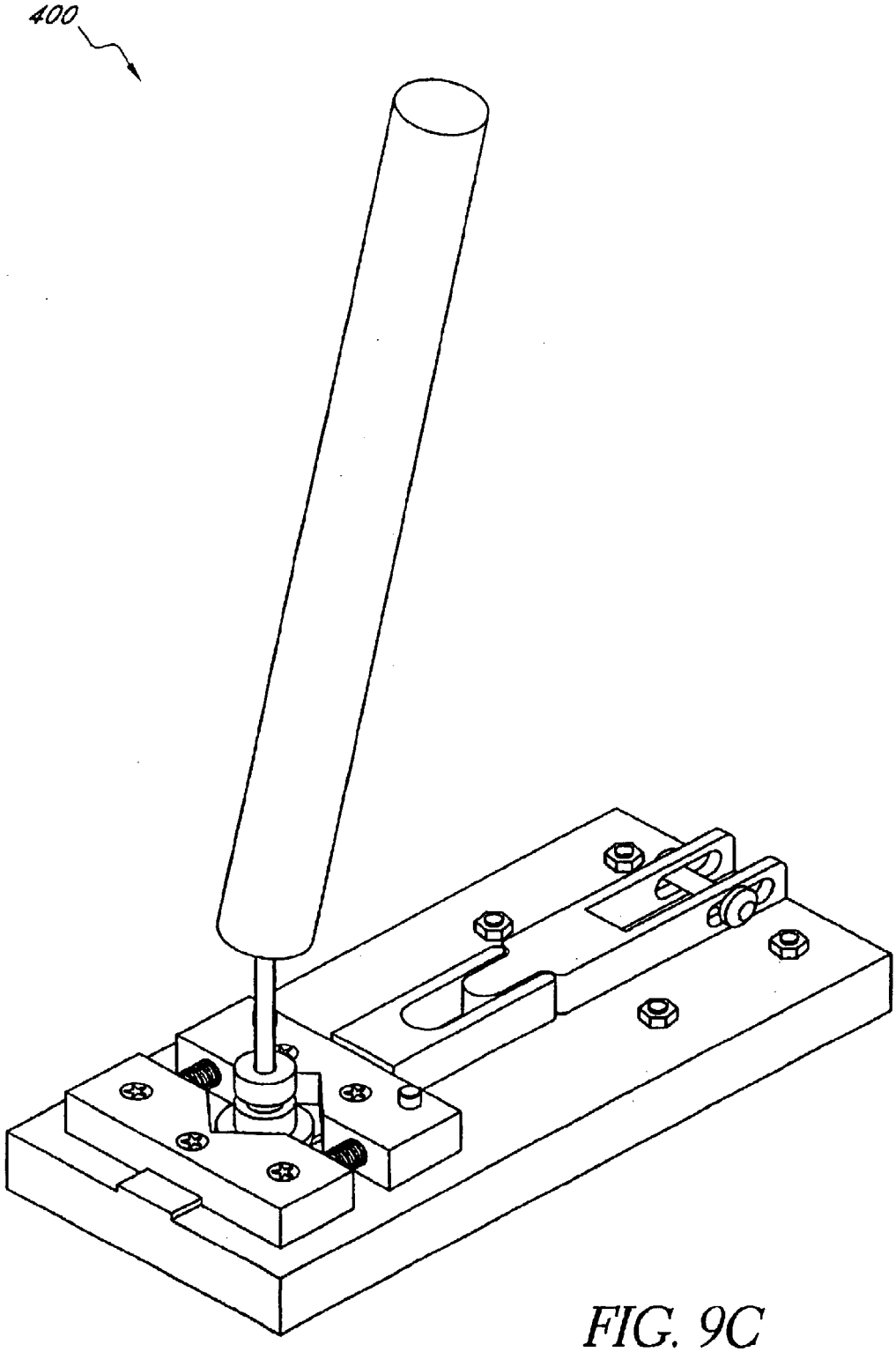
Figure 9D:
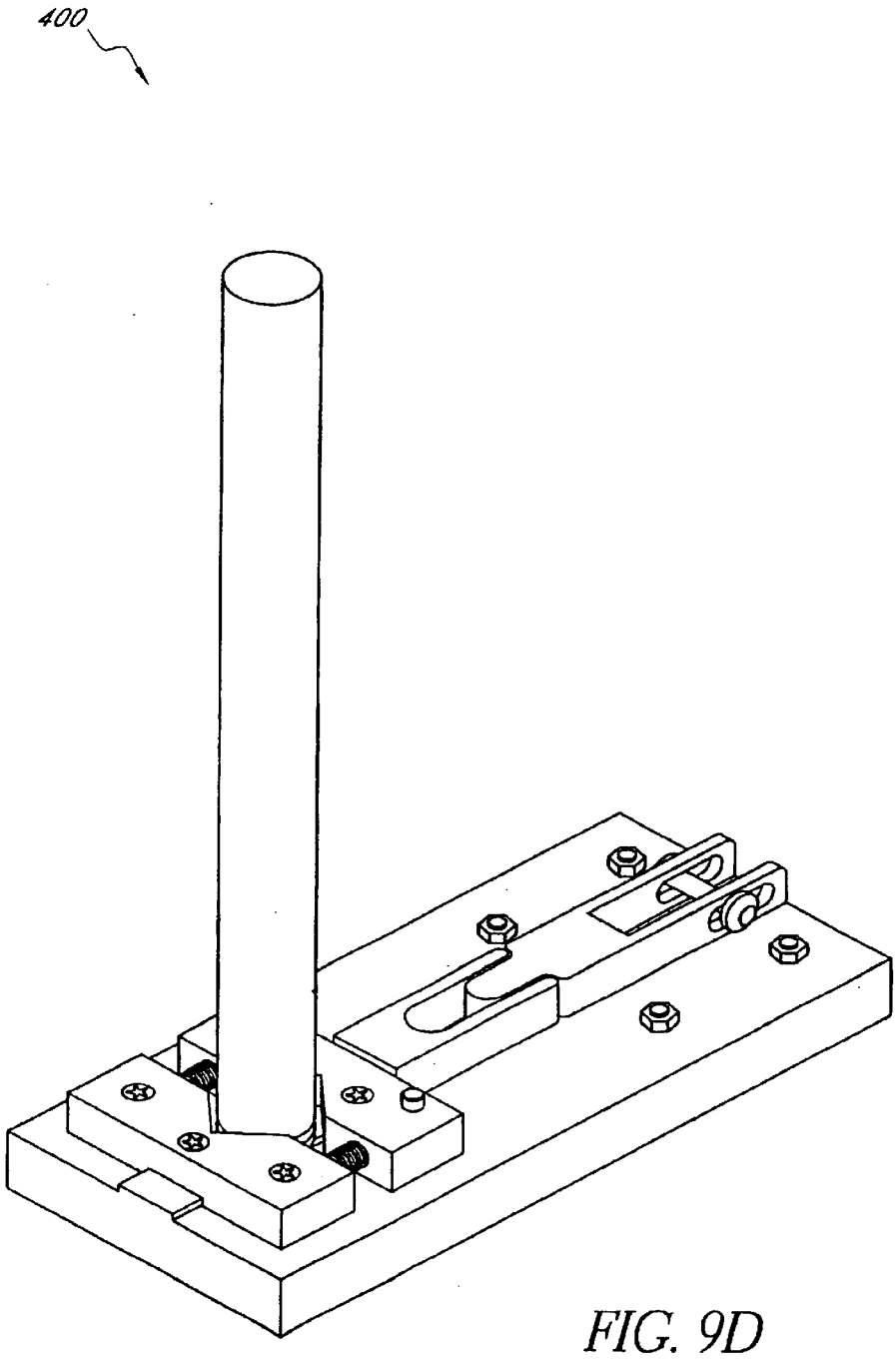

Crimping of the plugs 58 and 60 to the conduit can preferably be accomplished using any suitable crimping device. One such device is shown in FIGS. 9A–9D. As shown in FIG. 9A, a pneumatic fixture is bench mounted, with a peg extending vertically from the bench. A plug is slipped over the peg, as shown in FIG. 9B. The plug is covered with a conduit, shown in FIG. 9C, which preferably has a ½" or ¾" diameter. Using the pneumatic crimping device, the conduit is crimped, preferably in only about one second, onto the plug, as shown in FIG. 9D. It will be appreciated that various crimping mechanisms can be used, and therefore, the plug need not be crimped by the device or methods shown in FIGS. 9A–9D.

Figure 10:
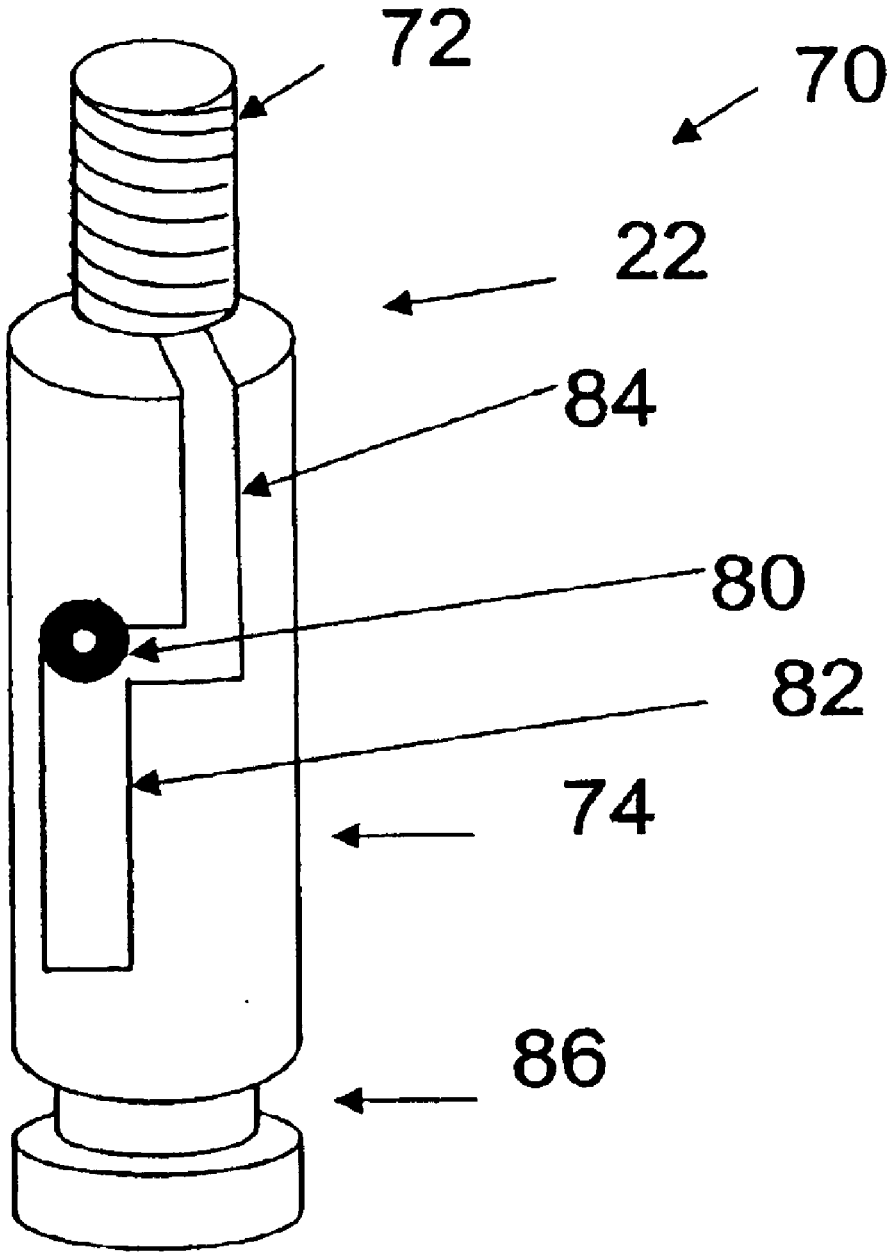
FIG. 10 is a perspective view of another embodiment of a plug having retractable threads.

FIG. 10 illustrates another design of a plug 70 having a retractable threads similar to the embodiment of FIG. 2C. The plug includes a threaded end 72, which moves into and out of the tubular body portion 74. The threaded end 72 is integrally formed with a shaft 76 (not shown) which remains internal to the tubular body portion 74 in an opening 88 (described below). A spring 78 (shown in FIG. 11A) is also positioned within the opening 88 of the tubular body portion 74 below the shaft 76.

Provided on the shaft 76 is a pin 80, which extends into a slot 82 provided in the wall of the body portion. The spring within the body portion presses against the bottom of the shaft 76, forcing the threaded end 72 outward, and correspondingly, positioning the pin at the top of the slot 82. Thus, the pin 80, when contacting the top of the slot, prevents the threaded end 72 and the shaft 76 from exiting the body portion 74, and also prevents rotation of the threaded end 72.

Near the top of the slot 82, a passageway 84 is provided to allow the threaded end 72 and the shaft 76 to exit the tubular body portion 74. An operator can remove the threaded end from the body portion 74 by pressing slightly down on the threaded end 72, and turning the threaded end (in the embodiment shown, counter-clockwise) such that the pin 80 follows the passageway 84. The passageway 84 turns up toward the top end of the body portion 74, which allows the threaded end to be removed.

The tubular body portion further includes a groove 86 near the end of the plug opposite the threaded end 72. This groove, as with the embodiments of FIGS. 5A–5C described above, enables the plug to be inserted into a conduit and crimped therein to provide excellent pull out strength. Once the plug is inserted and crimped at each end of the conduit, a duct can be reinforced such as shown in FIG. 4 above.

Figure 11B:
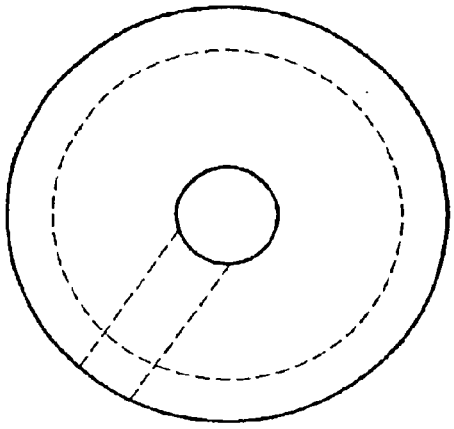
FIG. 11B is an end view of the plug of FIG. 11A.
Figure 11A:
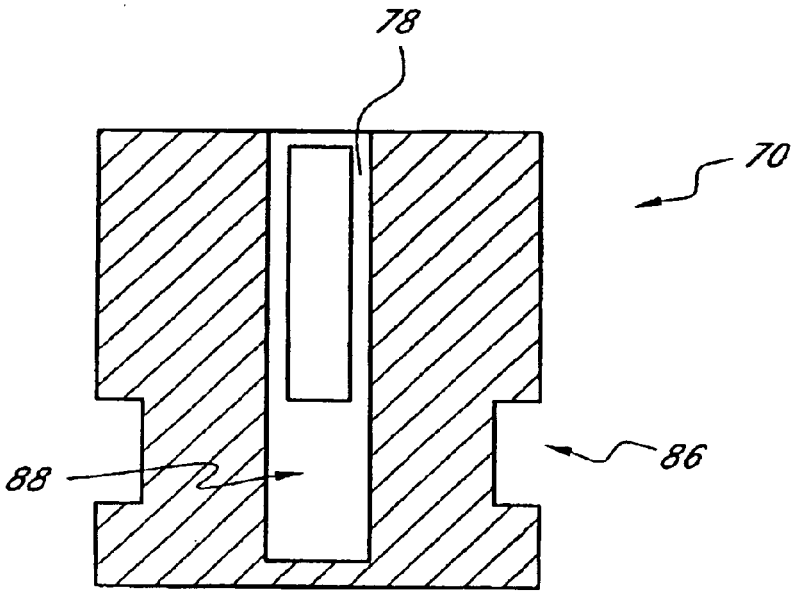
FIG. 11A is a cross-sectional view of the plug of FIG. 10.

FIGS. 11A and 11B illustrate one preferred design for the plug 70. In this embodiment, the opening 88 in which the spring 78 and the shaft 76 are inserted preferably has a diameter of about 5/16" and a depth of about 1.4". The overall length of the plug is about 1.5", with the groove 86 located about 1.14" from the outer end of the plug (i.e., the end that is flush with the end of the conduit) and about 0.15" from the inner end of the plug. The groove 86 in this embodiment preferably has a length of about 0.21 inches and a depth of about 0.07". The slot 82 and passageway 84 preferably have a width of about 3/16", with the bottom of the slot located about 1.09" from the outside end of the plug. The plug can have a variety of diameters, and in two preferred embodiments, has a diameter of about 0.81" or about 0.605".

Figure 12:
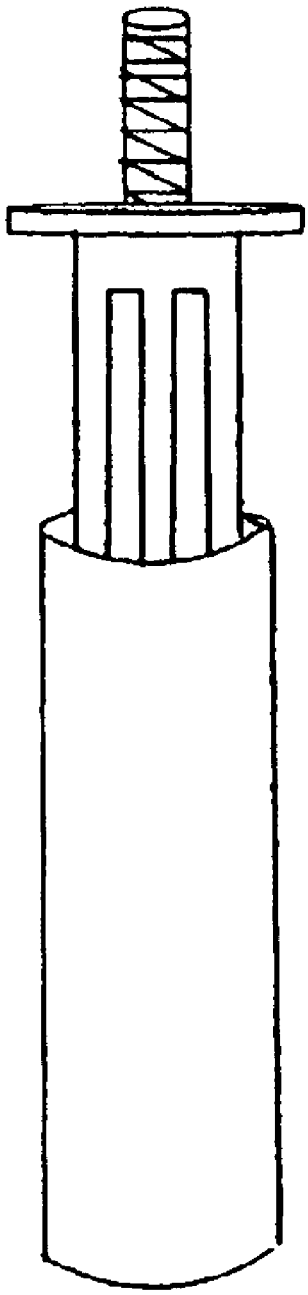
FIG. 12 is a perspective view of another embodiment of a plug having retractable threads being inserted into a conduit.

FIG. 12 illustrates an alternative embodiment of a plug having retractable threads being inserted into a conduit. This plug design is similar to the design of FIG. 2C, except that the walls 42 of the tubular body portion 24 have slots extending longitudinally therein from the inner end of the plug (i.e., the end adapted to be positioned away from the end of the conduit) and partially toward the head 22. Like the embodiment of FIG. 2C, the walls 42 are tapered such that the cavity 46 inside the body portion has a smaller diameter toward the proximal end or top end of the body portion.

Although the embodiments described herein relate to reinforcement of air conditioning ducts, it will be appreciated that the preferred embodiments of the present invention may be used in other applications as well. It will be appreciated that the plugs 18 described above may be used in applications with and without the conduit 32. For example, a conduit having plugs with retractable threads may be used for inserting shower curtain rods. In another example, plugs with retractable threads may be used for furniture legs. In such an embodiment, in fact, the retractable portion of the plug need not be threaded. Other possible uses include hangers between doors and inside closets, and clothes hangers in automobiles.

It should be understood that certain variations and modifications of this invention will suggest themselves to one of ordinary skill in the art. The scope of the present invention is not to be limited by the illustrations or the foregoing descriptions thereof, but rather solely by the appended claims.

What is claimed is:

1. A reinforcement system, comprisinga duct work:

a conduit having a first end and a second end;

a pair of plugs insertable into said first and second ends of said conduit, each of said plugs having a groove extending along the circumference of the plug, wherein the plugs are crimped inside the conduit along said grooves, said crimping being located at a distance spaced from the ends of the conduit and configured to prevent the plugs from pulling out of the conduit wherein each of the plugs is connected to the duct work.

2. The reinforcement of claim 1, wherein each of said plugs has a threaded end extending out of said plug and being retractable into said plug.

3. The reinforcement of claim 1, wherein each of said plugs has an internal threaded opening extending at least partially through said plug.

4. The reinforcement of claim 3, further comprising a bolt insertable into said threaded opening.

5. A plug for insertion into an end of a conduit for securing the conduit to a surface of a duct, the plug comprising:

a body portion having a first end and a second end and having substantially the same outer dimension at both ends so that the body portion can be fully inserted into the conduit such that the plug secures the conduit to the surface of the duct;

an opening extending from the first end at least partially through said body portion; and a groove extending at least partially along the circumference of the body portion, the groove adapted to receive a crimped portion of the conduit when the plug is inserted into the end of the conduit.

6. The plug of claim 5, wherein the opening is internally threaded.

7. The plug of claim 6, farther comprising a threaded member retractably positioned within the opening.

8. The plug of claim 7, further comprising a spring within said opening.

9. A reinforced duct work, comprising:

duct work having opposing surfaces, each of the surfaces having a hole therein aligned with an opposing hole; and a conduit having a first end and a second end, wherein the conduit has a plug inserted into each end thereof, each plug having a groove extending along at least a portion of the plug, and wherein the conduit is crimped to the plugs along the grooves;

wherein the conduit is positioned such that the first and second ends are aligned with said holes and said conduit is secured to said surfaces of said duct work.

10. The reinforced duct work of claim 9, wherein said conduit is secured to said surfaces of said duct work by bolts inserted through the holes in the duct work and into internally threaded holes in each plug at each end of the conduit.

11. The reinforced duct work of claim 9, wherein each plug has a retractable threaded end.

12. The reinforced duct work of claim 11, wherein the retractable threaded ends of each plug extend through one of said holes when said conduit is aligned therewith, and further comprising nuts tightened over the retractable threaded ends against the surface corresponding to said holes.

13. The reinforced duct work of claim 9, wherein the duct work is air conditioning duct.

14. A method for reinforcing duct work, the duct work having opposing surfaces, each of the surfaces having a hole therein aligned with an opposing hole, the method comprising:

providing a conduit having a first end and a second end, wherein the conduit has a plug inserted into each end thereof, each plug having a groove extending along at least a portion of the plug, and wherein the conduit is crimped to the plugs along the grooves;

positioning said conduit such that the first and second ends are aligned with said holes; and securing the conduit to the duct work.

15. The method of claim 14, wherein securing the conduit to the duct work comprises inserting bolts through the holes in the duct work and into internally threaded holes in each plug at each end of the conduit, and tightening the bolts within the plugs to secure the conduit to the duct work.

16. The method of claim 14, wherein each plug has a retractable threaded end that extends through one of the holes when the conduit is aligned therewith, and seeming the conduit to the duct work comprises tightening nuts over the retractable threaded ends against the surface corresponding to said hole to secure the conduit to the duct work.

17. A reinforcement system comprising:

a structure to be reinforced having opposing surfaces; a conduit sized to be placed between the opposing surfaces; and a plug comprising;

a body portion having a first end and a second end;

an opening extending from the first end at least partially through said body portion, the opening being internally threaded; and a groove extending at least partially along the circumference of the body portion, the groove adapted to receive a crimped portion of the conduit when the plug is inserted into the end of the conduit;

wherein at least a portion of the plug is crimped in the conduit and is secured to the structure.

18. The plug of claim 17, wherein the body portion has a generally smooth outer surface.

19. The plug of claim 18, wherein the smooth outer surface is configured to slidably engage an inner surface of the conduit.

20. A plug for performing the method of claim 14.

* * * * *